US008875987B2

(12) United States Patent
Supulski et al.

(10) Patent No.: US 8,875,987 B2
(45) Date of Patent: Nov. 4, 2014

(54) EXTENSION MAILBOX

(76) Inventors: Stanley Supulski, Clarks Summit, PA (US); Sarah Wesko, Clarks Summit, PA (US)

( * ) Notice: Subject to any disclaimer, the term of this patent is extended or adjusted under 35 U.S.C. 154(b) by 0 days.

(21) Appl. No.: 13/481,907

(22) Filed: May 28, 2012

(65) Prior Publication Data

US 2013/0098980 A1 Apr. 25, 2013

Related U.S. Application Data

(60) Provisional application No. 61/549,361, filed on Oct. 20, 2011.

(51) Int. Cl.
*A47G 29/12* (2006.01)
*A47G 29/122* (2006.01)

(52) U.S. Cl.
CPC ..... *A47G 29/1209* (2013.01)
USPC ..... 232/29; 232/17; 232/38

(58) Field of Classification Search
USPC ..... 232/29, 33, 17, 45, 38; 220/23.88; 206/515, 518–520
See application file for complete search history.

(56) References Cited

U.S. PATENT DOCUMENTS

| | | | | | |
|---|---|---|---|---|---|
| 2,781,964 | A | * | 2/1957 | Ledgerwood | 232/17 |
| 4,896,827 | A | * | 1/1990 | Economou | 232/17 |
| 5,009,366 | A | | 4/1991 | Van Druff | |
| 1,992,640 | A | | 1/1993 | Steen | |
| 5,425,501 | A | | 6/1995 | Wesorick | |
| 5,988,495 | A | * | 11/1999 | Lackey et al. | 232/17 |
| D438,363 | S | * | 2/2001 | Lackey et al. | D99/29 |
| D452,358 | S | * | 12/2001 | Lackey et al. | D99/29 |
| 6,347,736 | B1 | * | 2/2002 | Lackey et al. | 232/17 |
| 6,543,680 | B1 | | 4/2003 | McCormack | |
| 6,698,651 | B1 | | 3/2004 | Green | |
| 6,923,367 | B1 | * | 8/2005 | Grossman et al. | 232/17 |
| 6,997,373 | B2 | | 2/2006 | Flores | |
| 7,004,380 | B2 | | 2/2006 | Gunvaldson | |
| 7,210,616 | B1 | * | 5/2007 | Van Watermulen | 232/29 |
| 2004/0195304 | A1 | | 10/2004 | Kujawa | |
| 2005/0121503 | A1 | | 6/2005 | Billings | |
| 2005/0247770 | A1 | | 11/2005 | Priest | |

* cited by examiner

*Primary Examiner* — William Miller
(74) *Attorney, Agent, or Firm* — Thien Tran, Esq.; Access Patent Group, LLC

(57) ABSTRACT

An extension mailbox which includes a main mailbox housing mounted onto a vertical support extending from the ground. A plurality of auxiliary mailbox housings, are nested concentrically within the main mailbox housing. A rail system allows the auxiliary mailbox housings to project outwardly away from the main mailbox housing in a telescopic horizontal manner.

10 Claims, 5 Drawing Sheets

EXTENSION MAILBOX

CROSS-REFERENCE TO RELATED APPLICATION

This application claims the benefit of Provisional Patent Application No. 61/549,361, filed on Oct. 20, 2011, In the United States Patent & Trademark Office, the disclosure of which is incorporated herein by reference.

BACKGROUND OF THE INVENTION

1. Field of the Invention

The present invention relates to a rural mailbox, and more particularly, an extension mailbox.

After a snowstorm, many homeowners shovel a path for the mail truck, but a snow plow may come along and cover the mailbox with snow again, negating all the homeowner's work. When the mailbox is covered, the homeowner may miss the mail delivery that day and the mail carrier will not be able to pick up an important piece of mail, such as a bill payment, that the homeowner was ready to send. Besides that, the person who clears the path to the mailbox may be at risk of getting injured, as shoveling snow is an arduous and time consuming task. Also, the yard may be full of debris when spring rolls around because of all the shoveling from the road during the winter. A more efficient solution is necessary.

The extension mailbox allows users to easily bring the mailbox to the mail truck during the winter months, instead of trying to shovel a path in snow toward a conventional mailbox. The extension mailbox is easily attached to a standard mailbox post with a bolt and nut. The extension mailbox simply expands beyond the built-up wall of snow, guaranteeing that the mail will be delivered. By using the present invention, anyone who lives in an area where the snow threatens to cover the mailbox will not miss any mail and can also sleep longer knowing that they do not have to get up early to clear a path in the snow to the mailbox.

2. Description of the Prior Art

Numerous innovations for mailboxes have been provided in the prior art that will be described. Even though these innovations may be suitable for the specific individual purposes to which they address, however, they differ from the present invention.

A FIRST EXAMPLE, U.S. Pat. No. 1,992,640, Issued on Feb. 26, 1935, to Steen teaches an extensible mailbox, comprising a body portion closed at its rear end and open at its front end, the front end having a beaded edge, a recess in the portion, a member telescopically engaging the portion, the member being open at its rear end and its front end, the front end having a beaded edge of greater cross sectional area than the first named beaded edge, a door hingedly mounted to the front end of the member, a flange carried by the door adapted to embrace the second beaded edge and provide a weatherproof connection for the door therewith, the flange having a width which will permit it also to embrace the first beaded edge and provide a weatherproof connection with the front end of the body portion when the member is fully telescoped within the portion, a retaining device for the door, and a catch extend from the member and slideably engaging the recess for limiting the longitudinal travel of the member.

A SECOND EXAMPLE, U.S. Pat. No. 5,425,501, Issued on Jun. 20, 1995, to Wesorick teaches an improved sliding hooded mail carrier tray for a conventional rural mailbox structure. The rural type mailbox has a rectangular bottom panel, a back panel extending from one end of the rectangular bottom panel, a U-shaped roof portion extending from opposite sides of the bottom panel and a swinging pivotal door at another end. The improvement consists of a transparent hooded mail carrier having a slightly smaller cross sectional configuration compared to a cross-sectional configuration of the mailbox. The hooded mail carrier comprises a rectangular bottom wall, a back wall extending from the back end of the rectangular bottom wall and a U-shaped hood portion extending from opposite sides of the rectangular bottom wall defining an enclosure with the front end of the hooded mail carrier having an opening for receipt of mail. The hooded mail carrier also has upper rails on opposite sides thereof mounted on the outside of the U-shaped hood portion and lower rollers positioned on a rear portion of the hooded mail carrier beneath the upper rails. The upper rails of the hooded mail carrier are cooperable with upper mailbox rollers attachable at opposite sides of an inside wall of the mailbox and the lower rollers of the hooded mail carrier are cooperable with lower mailbox rails attachable at opposite sides of an inside wall of the mailbox in order for the hooded mail carrier to slide smoothly in horizontal telescoping engagement in and out of the mailbox. A stop lever is mounted on an inside wall of the mailbox for co-action with the upper rails to ensure that the hooded mail carrier does not come all the way out from the mailbox wherein any mail can be easily inserted and retrieved protecting the mail from weather elements when the hooded mail carrier is extended from the mailbox. When the hooded mail carrier is fully inserted into the mailbox, then the mailbox can be closed with the hooded mail carrier enclosed within the mailbox.

A THIRD EXAMPLE, U.S. Pat. No. 6,543,680, Issued on Apr. 8, 2003, to McCormick teaches a slide mount for a rural mailbox comprises a plastic base defining multiple, fixed, horizontal slideways and a slide member slidably and complementally assembled to the base. The slide member is sized and shaped to receive the mailbox thereover and to be secured to the mailbox by screws. A handle is attached to the front of the slide member, and a one-way stop prevents the slide member from being fully removed from the base member.

A FOURTH EXAMPLE, U.S. Patent Office Publication No. 2004/0195304, Published on Oct. 7, 2004, to Kujawa et al. teaches a mailbox comprises a housing and a hinged door, a spring loaded locking mechanism is attached to the housing and the door, a delivered mail detection mechanism, and an outgoing mail indicator means operably cooperate with the locking mechanism to enable or disable the locking mechanism under appropriate conditions as described herein. The delivered mail detection mechanism includes an external mail present indicator.

A FIFTH EXAMPLE, U.S. Pat. No. 7,004,380, Issued on Feb. 28, 2006, to Gunvaldson teaches an extendable and retractable mailbox tray, which is a sliding, guided tray that is mountable within into a standard, rural mailbox. The tray extends from the mailbox when the mailbox door is opened, and retracts back within the mailbox when the mailbox door is closed. The guided mailbox tray assembly includes a tray, which may be referred to as a "sled." Preferably, the tray is cut out and bent into the form of a rectangular box from a single sheet of galvanized metal. The tray has a side panel and a runner slot cut within the side panel. A runner with a slot fastener end, and a bracket fastener end that is slidingly mountable into the runner slot. A bracket is mountable to the openable door of the mailbox. The bracket includes a runner fastener that is hingeably attachable to the bracket fastener of the runner. The tray extends from the mailbox upon opening the door and the tray retracts back into the mailbox when the door is closed. Preferably, the tray has a pair of side panels, each with a runner slot, a pair of runners, each with a slot fasteners and bracket fasteners, for slidingly connecting the runners to the tray, and pivotably connecting the bracket to the runners.

It is apparent now that numerous innovations for mailboxes have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide an extension mailbox that avoids the disadvantages of the prior art.

ANOTHER OBJECT of the present invention is to provide an extension mailbox that is simple and inexpensive to manufacture.

STILL ANOTHER OBJECT of the present invention is to provide an extension mailbox that is simple to use.

BRIEFLY STATED, STILL YET ANOTHER OBJECT of the present invention is to provide an extension mailbox which comprises a main mailbox housing mounted onto a vertical support extending from the ground. A plurality of auxiliary mailbox housings, are nested concentrically within the main mailbox housing. A rail system allows the auxiliary mailbox housings to project outwardly away from the main mailbox housing in a telescopic horizontal manner.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

Figure 1:
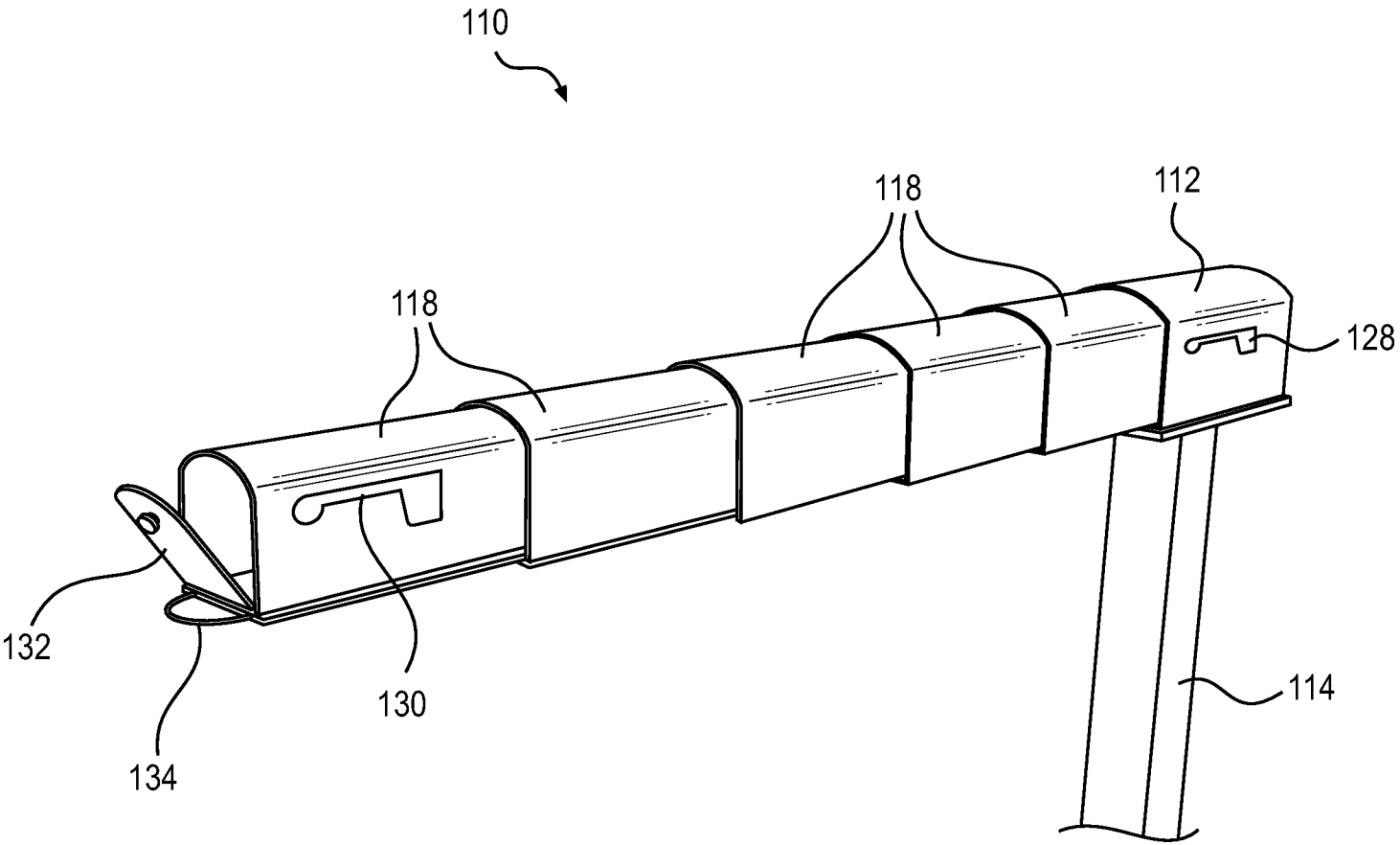
FIG. 1 is a front perspective view of the present invention in an extended position.

110 extension mailbox
112 main mailbox housing of extension mailbox 110
114 vertical support
116 ground
118 auxiliary mailbox housing of extension mailbox 110
120 rail system of extension mailbox 110
122 track member of rail system 120
124 slide member of rail system 120
126 setback front stop end on track member 122
128 first flag on main mailbox housing 112
130 second flag on innermost auxiliary mailbox housing 118
132 front door on innermost auxiliary mailbox housing 118
134 handle on innermost auxiliary mailbox housing 118
136 removable back panel on main mailbox housing 112
138 screw for removable back panel 136
140 removable back panel on auxiliary mailbox housing 118
142 screw for removable back panel 140

DETAILED DESCRIPTION OF THE PREFERRED EMBODIMENT

Figure 2:
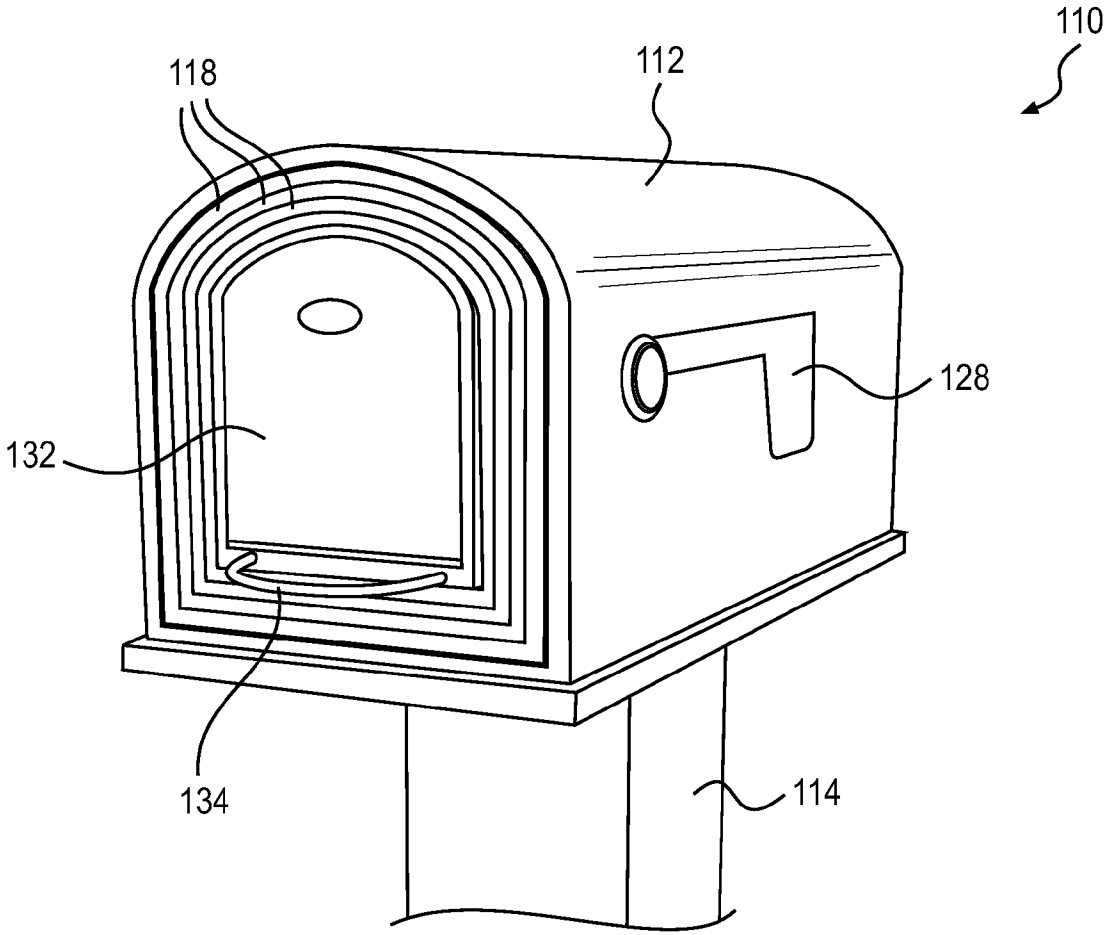
FIG. 2 is a front perspective view of the present invention in a retracted nested position.

As shown in the FIGS. 1-2: the present invention is an extension mailbox 110 which comprises a main mailbox housing 112 mounted onto a vertical support 144 extending from the ground 116. A plurality of auxiliary mailbox housings 118 are nested concentrically within the main mailbox housing 112. A rail system 120 allows the auxiliary mailbox housings 118 to project outwardly away from the main mailbox housing 112 in a telescopic horizontal manner.

As shown in FIGS. 1 and 2, a first flag 128 is pivotally mounted onto one side of the main mailbox housing 112. A second flag 130 is pivotally mounted onto one side of the innermost auxiliary mailbox housing 112. The innermost auxiliary mailbox housing 118 comprises a front door 132 that swings downwardly and a handle 134 used to pull out all of the auxiliary mailbox housings 118 from the main mailbox housing 112.

Figure 3:
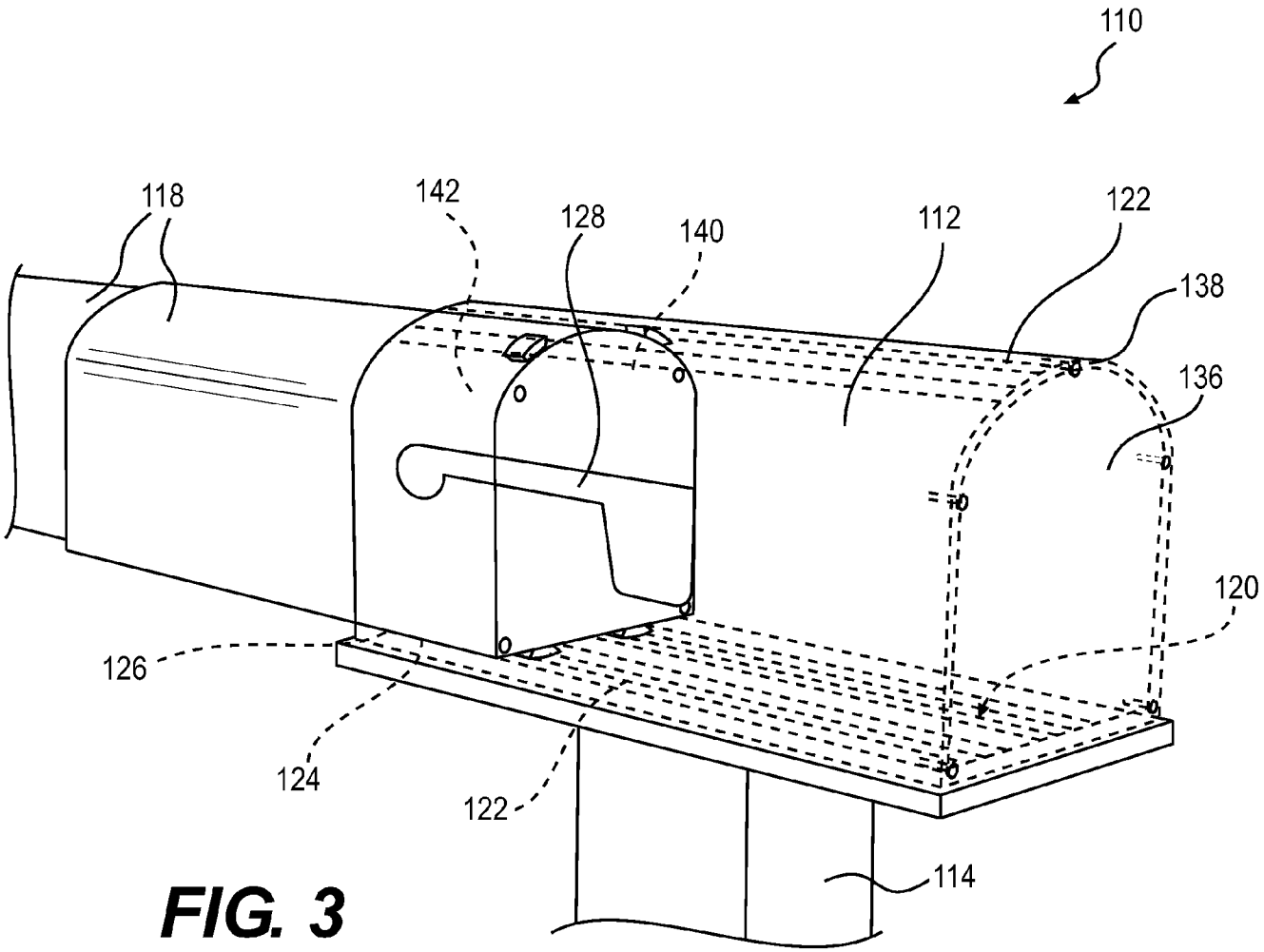
FIG. 3 is a rear perspective view with parts broken away of the present invention in the extended position.

Referring to FIG. 3, the rail system 120 consists of a plurality of track members 122 located on inner surfaces of the main mailbox housing 112 and the auxiliary mailbox housings 118. A plurality of slide members 124 are located on outer surfaces and toward rear of the auxiliary mailbox housings 118, whereby each of the slide members 124 will ride within each of the track members 122. Each track member 122 comprises a setback front stop end 126 to prevent a respective slide member 124 from leaving the track member 122.

Figure 4:
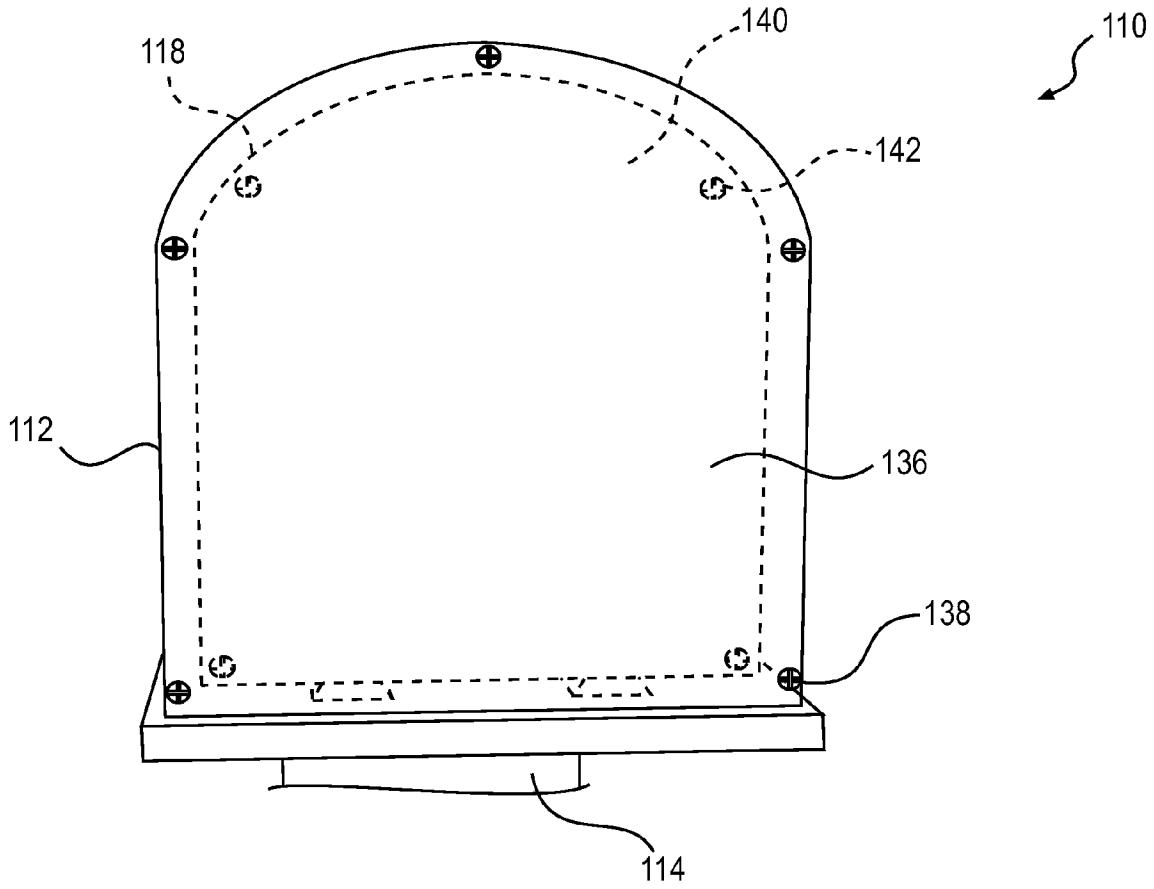
FIG. 4 is a rear view taken in the direction of arrow 4 in FIG. 3.

Referring to FIGS. 3 and 4, the main mailbox housing 112 contains a removable back panel 136 and a plurality of screws 138 to retain the removable back panel 136 to the main mailbox housing 112. The removable back panel 136 is recessed slightly in order to prevent water from entering the main mailbox housing 112. Each auxiliary mailbox housing 118 comprises a removable back panel 140 and a plurality of screws 142 to retain the removable back panel 140 to the auxiliary mailbox housing 118.

The main mailbox housing 112 is approximately seventeen inches in length. When the auxiliary mailbox housings 118 are fully extended from the main mailbox housing 112 the measurement will be approximately six feet in length. Each setback front stop end 126 is approximately four inches in length, so that there will always be at least a four inch overlap between two auxiliary mailbox housings 118 to help keep them stable.

The extension mailbox 110 allows mail carriers to deliver mail to a user's mailbox no matter how much it may snow. The present invention is comprised of the plurality of auxiliary mailbox housings 118 nested inside the main mailbox housing 112, which measures about seventeen inches long. The auxiliary mailbox housings 118 utilize the rail system 120, thereby allowing them to be pulled from each other. There are four track members 122, two toward the top and two on the bottom. On every auxiliary mailbox housing 118 there are slide members 124 located at the rear that stick outward. The slide members 124 ride in the track members 122 of the auxiliary mailbox housing 118 around it.

Every auxiliary mailbox housing 118, except the innermost one has the track members 122. The track members 122 have the setback front stop end 126 four inches from the front, so there always will be at least a four inch overlap between two auxiliary mailbox housings 118. This keeps the entire extension mailbox 110 stable. When all of the nested auxiliary mailbox housings 118 are fully extended, the measurement will be about six feet long. The first flag 128 is on the main mailbox housing 112 and the second flag 130 is on the innermost auxiliary mailbox housing 118. The innermost auxiliary housing 118 also contains the front door 132 that swings down and the handle 134 used to pull out all of the nested auxiliary mailbox housings 118.

Figure 5:
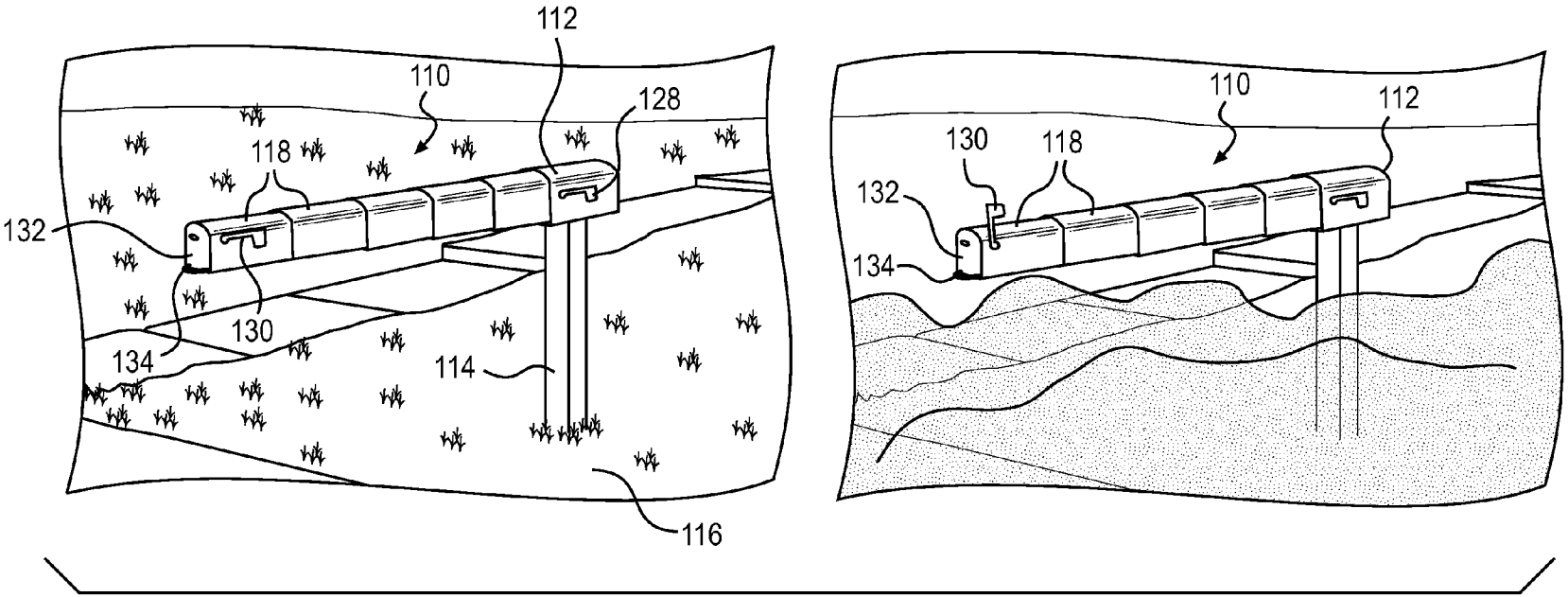
FIG. 5 are two front perspective views showing the present invention being used at different times of the year.

The back panels 136, 140 of the mailbox housings 112, 118 are removable. The screws 138, 142 go into pre-drilled holes on the edge of the mailbox housings 112, 118 to secure the back panels 136, 140. The main mailbox's back panel 136 is recessed slightly in order to prevent water from getting in. As shown in FIG. 5, when a snowstorm is about to hit, a person will extend the extension mailbox 110 out, so that the person does not have to shovel the snow out for the mail carrier. The exact specifications for the present invention may vary.

It will be understood that each of the elements described above, or two or more together, may also find a useful application in other types of constructions differing from the types described above.

While the invention has been illustrated and described as embodiments of an extension mailbox, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An extension mailbox which comprises:

a) a main mailbox housing mounted onto a vertical support extending from a ground;

b) a plurality of auxiliary mailbox housings nested concentrically within the main mailbox housing; and c) a rail system to allow the auxiliary mailbox housings to project outwardly away from the main mailbox housing in a telescopic horizontal manner; wherein the rail system comprises:

d) a plurality of track members located on inner surfaces of the main mailbox housing and the auxiliary mailbox housings; and e) a plurality of slide members located on outer surfaces and toward a rear of the auxiliary mailbox housings, whereby each of the slide members will ride within each of the respective track members.

2. The extension mailbox as recited in claim 1, wherein each track member comprises a setback front stop end to prevent a respective slide member from leaving the track member.

3. The extension mailbox as recited in claim 2, wherein each setback front stop end is approximately four inches in length, so that there will always be at least a four inch overlap between two auxiliary mailbox housings to help keep them stable.

4. The extension mailbox as recited in claim 1, further comprising:

a) a first flag pivotally mounted onto one side of the main mailbox housing; and b) a second flag pivotally mounted onto one side of the innermost auxiliary mailbox housing.

5. The extension mailbox as recited in claim 4, wherein the innermost auxiliary mailbox housing comprises:

a) a front door that swings downwardly; and b) a handle used to pull out all of the auxiliary mailbox housings from the main mailbox housing.

6. The extension mailbox as recited in claim 1, wherein the main mailbox housing comprises:

a) a removable back panel; and b) a plurality of screws to retain the removable back panel to the main mailbox housing.

7. The extension mailbox as recited in claim 6, wherein the removable back panel is recessed slightly in order to prevent water from entering the main mailbox housing.

8. The extension mailbox as recited in claim 1, wherein each auxiliary mailbox housing comprises:

a) a removable back panel; and b) a plurality of screws to retain the removable back panel to the auxiliary mailbox housing.

9. The extension mailbox as recited in claim 1, wherein the main mailbox housing is approximately seventeen inches in length.

10. The extension mailbox as recited in claim 1, wherein when the auxiliary mailbox housings are fully extended from the main mailbox housing the measurement will be approximately six feet in length.

* * * * *